United States Patent [19]

Wirtgen

[11] Patent Number: 4,714,295

[45] Date of Patent: Dec. 22, 1987

[54] SCRAPING ROLLER MOUNTING MEANS FOR SCRAPING MACHINES FOR SCRAPING OFF ROADS

[76] Inventor: Reinhard Wirtgen, Hohner Strasse 2, D-5461 Windhagen, Fed. Rep. of Germany

[21] Appl. No.: 829,499

[22] Filed: Feb. 14, 1986

[30] Foreign Application Priority Data

Feb. 25, 1985 [DE] Fed. Rep. of Germany ..... 3506551

[51] Int. Cl.[4] ..... E01C 23/12

[52] U.S. Cl. ..... 299/39; 404/90; 172/483

[58] Field of Search ..... 404/90, 103, 121, 122; 299/39, 40; 172/123, 483; 180/13; 403/331, 407.1; 248/287, 285.1; 37/231

[56] References Cited

U.S. PATENT DOCUMENTS

| | | | |
|---|---|---|---|
| 1,432,349 | 10/1922 | McFarland | 403/407.1 |
| 1,581,784 | 4/1926 | Butler | 404/103 |
| 1,854,277 | 4/1932 | Schatz | 248/295.1 X |
| 2,929,304 | 3/1960 | Jones | 404/122 |
| 3,375,878 | 4/1968 | Dorn | 172/483 X |
| 4,387,929 | 6/1983 | Wirtgen | 299/39 |

*Primary Examiner*—James A. Leppink
*Assistant Examiner*—Matthew Smith
*Attorney, Agent, or Firm*—Steinberg & Raskin

[57] ABSTRACT

In a scraping roller mounting apparatus for scraping machines for scraping off roads, a motor-driven scraping roller is mounted rotatably by both ends in a frame arranged transversely to the direction of travel and attached to the chassis by two vertically adjustable mounting members. The frame is guided on the chassis by two dovetail-type slide and thrust guide members arranged at a mutual interval and aligned vertically.

10 Claims, 3 Drawing Figures

SCRAPING ROLLER MOUNTING MEANS FOR SCRAPING MACHINES FOR SCRAPING OFF ROADS

BACKGROUND OF THE INVENTION

The invention relates to a scraping roller mounting means for scraping machines for scraping off road surfaces with a frame arranged transversely to the direction of travel and attached to the chassis by two vertically adjustable mounting means, in which frame the scrapping roller is mounted rotatably by its end faces and is drivable by means of a motor at least at one end face.

Large scale scraping machines, which can deal in one pass with scraping widths up to 4 m, that is to say a lane of a freeway, require relatively high motor outputs to drive the scraping roller and also for the propulsion of the scraping machine. These outputs can be transmitted to the scraping roller by mechanical means or by the use of hydraulic motors.

The transmission of these powerful forces creates problems in the mounting of the scraping roller on the chassis, particularly since the scraping roller is intended to be vertically adjustable on the one hand, and also, convenient, laterally inclinable. Lastly, it is necessary to ensure that vibrations which have disadvantageous influences upon the useful life of the machine and upon the scraping result are largely avoided.

A scraping roller mounting means for scraping machines is already known (German Pat. No. 2,942,670), in which these requirements are met in that the frame is guided between two parallel guide surfaces of the chassis arranged consecutively in the direction of travel. To prevent any lateral displacement of the scraping roller, the frame is connected to the chassis via a groove and tongue connection. The vertical guide surfaces provided in the proximity of the scraping roller ends retain the frame with the scraping roller mounted therein on the chassis slidably in the vertical direction but rigidly, so that this scraping roller mounting means can be loaded with powerful forces. It is moreover ensured that the scraping roller can be adjusted within wide limits both vertically and also as to its lateral inclination.

However, this scraping roller device has the disadvantage that it occupies a comparatively large overall volume and furthermore, due to the arrangement of the scraping roller between the parallel guide surfaces, access conditions to the scraping roller for the purpose of executing maintenance operations, such as the exchange of the scraping blades, for example, are unfavorable. Furthermore, the groove and tongue connection provided to prevent the lateral wandering of the scraping roller requires many components. Although the latter point is obviated in another known scraping roller mounting means (German Offenlegungsschrift No. 3 049 318), by the fact that the groove and tongue connection is associated with one of the guide surfaces, nevertheless the problem that the connection tends to jam due to insufficient possibilities for cleaning is inherent in such a solution.

SUMMARY OF THE INVENTION

It is proposed to eliminate these disadvantages by means of the invention. It is therefore the object of the invention to devise a scraping roller mounting means which occupies the smallest possible overall volume, is uncomplicated, and nevertheless permits the transmission of very powerful forces.

This object is achieved according to the invention in that the frame is guided on the chassis by means of two dovetail-type slide and thrust guide means arranged at a mutual interval and aligned vertically.

What is achieved by this measure according to the invention is that the guide surfaces located in front of the scraping roller in the direction of travel can be omitted. Consequently the overall volume is reduced compared to known devices. Moreover, access to the scraping roller in order to execute maintenance operations is now possible from the front without difficulty, because it is no longer masked by the guide surfaces located in front of the scraping roller in the direction of travel, as is the case with the known devices. The dovetail-type slide and thrust guide means not only guide the frame vertically, but also simultaneously safeguard it against lateral displacements. Additional groove and tongue connections, such as were necessary to prevent a lateral movement in the known devices, can be totally omitted.

According to an advantageous embodiment, each slide and thrust guide means consists of a guide rail attached to the chassis and having an approximately T-shaped guide channel cross-section, and of a sliding element attached to the frame and having a cross-section adapted, with play, to the guide channel cross-section. Such a construction of the slide and thrust guide means permits the lateral inclination of the frame with the scraping roller to a certain extent which is limited by the play of the sliding element in the guide channel.

The inclinability of the frame with the scraping roller can furthermore be improved and increased in that at least that part of each sliding element located in the guide channel is of circular construction. The sliding element can then be pivoted in the guide channel unobstructed by its own end edges, while this pivoting is limited only by the interval of the two sliding elements and of the two guide rails.

Although the inclinability of the frame with the scraping roller is improved with increasing play of the sliding element in the guide channel, nevertheless the lateral mobility, particularly in the horizontal position of the frame, is also increased thereby. This disadvantage can be eliminated in that the part located in the guide channel, and the part extending outwards therefrom, of at least one sliding element, are mutually eccentric so that the distance between the axes of the sliding element parts located in the guide channels is greater than that between the other sliding element parts.

It has been found convenient to construct the frame in the form of a shallow U, in the members of which the grinding roller is mounted, and with the base surface of which the slide and thrust guide means are associated. Such a construction permits particularly good access to the grinding roller when due for maintenance. This can be still further promoted by having the vertically adjustable mounting means articulated to the edge of the base surface of the frame.

For reasons of work safety, it may be advantageous to provide the U-shaped frame at its top side with a cover to which the vertically adjustable mounting means are articulated.

BRIEF DESCRIPTION OF THE DRAWINGS

The invention will be explained more fully with reference to the drawing, which contains an exemplary embodiment illustrated partially diagrammatically. In the drawing.

DESCRIPTION OF THE PREFERRED EMBODIMENTS

Figure 1:
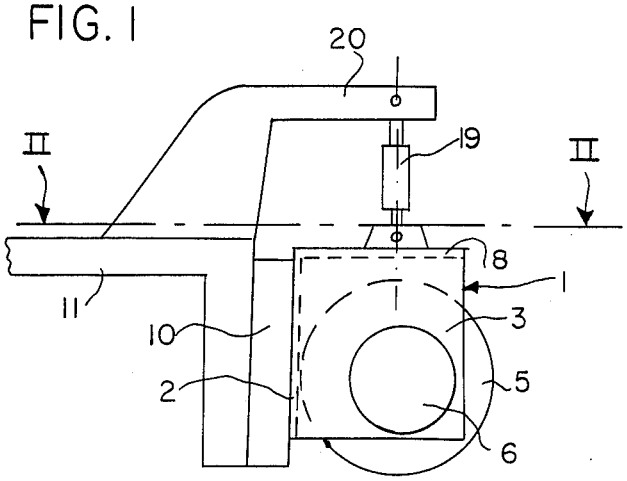
FIG. 1 shows a side elevation of the scraping roller mounting means according to the invention.

As may be seen from the figures, the scraping roller mounting means consists of a U-shaped frame 1 with a base part 2 and two members 3 and 4, in which the grinding or scraping roller 5 is mounted and to each of which a motor 6 or 7 for driving the scraping roller 5 is attached. The frame is provided at its top side with a cover 8.

The frame 1 is attached to the chassis 11 by means of two dovetail-type slide and thrust guide means 9 and 10. As may be seen, the two slide and thrust guide means 9 and 10 are arranged at a mutual interval and aligned vertically.

Each of the slide and thrust guide means 9 and 10 consists of a guide rail 12 with a T-shaped guide channel cross-section and a sliding element 13 attached to the frame 1.

The part 15 of each sliding element 13 located in the guide channel 14 is of circular construction. The circular part 15 communicates with the frame 1 via a tenon-shaped part 16. The tenon 16 is welded to the frame 1.

Figure 2:
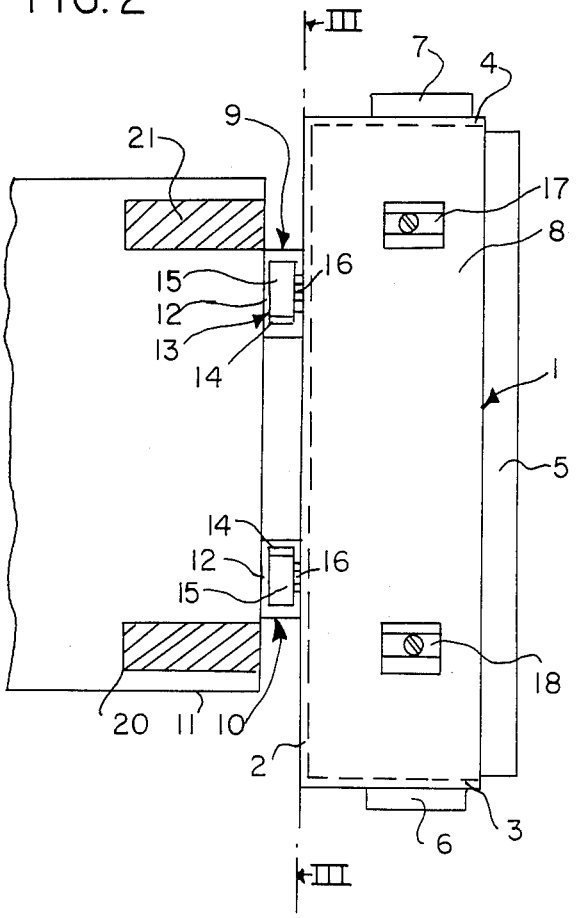
FIG. 2 shows a cross-section through the scraping roller mounting means according to the invention along the line II—II and FIG. 3 shows a cross-section through the scraping roller mounting means according to the invention along the line III—III.
Figure 3:
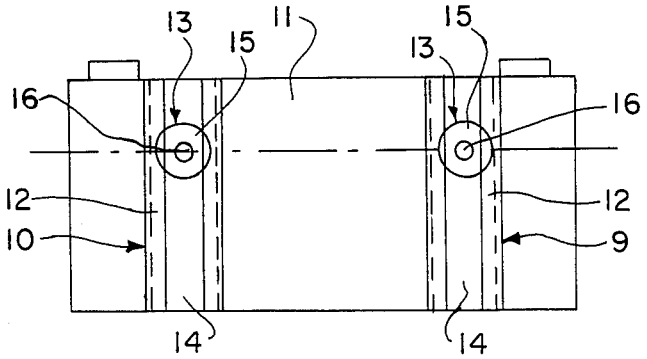

As may be seen particularly from FIGS. 2 and 3, the circular part 15 and the tenon 16 are arranged mutually eccentrically, so that the distance between the axes of the circular parts 15 is greater than the distance between the tenons 16. In this manner the frame, in its horizontal position, is secured against lateral mobility. Nevertheless it is possible to incline the frame, which is made possible by the play of the circular parts 15 in the guide channel 14.

Two pairs of bearing cheeks 17 and 18, in each of which the one end of an adjusting roller 19 is mounted rotatably, are present on the top side of the cover 8. The other end of the adjusting roller 19 is articulated to a jib 20 or 21 which rests upon the chassis 11.

According to another embodiment of the invention, in the case of one of the slide and thrust guide means the sliding element 13 is of circular construction and arranged to fit closely in its guide channel. It thus prevents any lateral displacement of the scraping roller.

In the case of the other slide and thrust guide means, the tenon 16 exhibits a relatively generous play in the guide channel and thus permits a lateral inclination of the scraping roller, whereas the sliding element, which is likewise of circular construction, supports the frame of the scraping roller securely on the guide means.

The stability of the scraping roller mounting means according to the invention is further increased by the provision, superimposed in each guide channel, of two sliding elements attached to the frame. In such an embodiment, however, the lateral inclination of the scraping roller is possible only to a very limited extent.

I claim:

1. Scraping roller mounting means for scraping machines for scraping off road surfaces with a frame arranged transversely to a direction of travel and and attached to a chassis by vertically adjustable mounting means, in which frame a scraping roller is mounted rotatably by its end faces and is drivable by a motor at least at one end face thereof, wherein the frame (1) is guided on the chassis (11) by slide and thrust guide means (9,10) aligned vertically, wherein said slide and thrust guide means (9,10) comprise two spaced guide rails (12) attached to the chassis (11), each having an approxmately T-shaped guide channel cross-section and two sliding elements (13) attached to the frame (1) and each having a cross-section adapted with play to the respective guide channel cross-section, and wherein at least a part (15) of each sliding element (13) located in the guide channel (14) is of substantially circular construction.

2. Scraping roller mounting means as claimed in claim 1, wherein the part (15) located in the guide channel (14), and a part (16) extending outwards therefrom of at least one sliding element (13) are mutually eccentric so that the interval of axes of the sliding element part (15) located in the guide channel (14) is greater than that between the other sliding element parts (16).

3. Scraping roller mounting means as claimed in claim 1, wherein the frame (1) is constructed having form of a shallow U, in the members (3, 4) on which the scraping roller (5) is mounted, and a base surface (2) of which the slide and thrust guide means (9, 10) are associated.

4. Scraping roller mounting means as claimed in claim 3 wherein the vertically adjustable mounting means (19) are articulated to the edge of the base surface (2).

5. Scraping roller mounting means as claimed in claim 3, wherein the U-shaped frame (1) comprises at its top side a cover (8) to which the vertically adjustable mounting means (19) are articulated.

6. The means of claim 5, wherein said vertically adjustable mounting means comprise a pair of jibs, each resting upon the chassis, a pair of bearing cheeks situated on a top side of said cover, and a pair of adjusting rollers, each roller articulated to a respective jib and rotatably mounted upon a respective bearing cheek.

7. The means of claim 1, additionally comprising a second pair of sliding elements attached to the frame (1), with two sliding elements situated in a respective channel.

8. The means of claim 2, wherein both said sliding elements have parts within (15) and extending outwardly from (16) the respective guide channel (14) which are mutually eccentric.

9. The means of claim 1, wherein said slide and thrust means are arranged between the chassis and said frame in the direction of travel of the scraping machine.

10. The means of claim 9, wherein said slide and thrusting means are arranged to the rear of the scraping roller in the direction of travel.

* * * * *